US006190126B1

(12) United States Patent
Haegele et al.

(10) Patent No.: US 6,190,126 B1
(45) Date of Patent: Feb. 20, 2001

(54) FAN IMPELLER ASSEMBLY FOR COOLING SYSTEMS OF INTERNAL COMBUSTION ENGINES

(75) Inventors: Karl Haegele; Gebhard Munz, both of Schorndorf (DE)

(73) Assignee: Haegele GmbH, Schorndorf (DE)

( * ) Notice: Under 35 U.S.C. 154(b), the term of this patent shall be extended for 0 days.

(21) Appl. No.: 09/391,189

(22) Filed: Sep. 7, 1999

(30) Foreign Application Priority Data

Sep. 7, 1998 (DE) ..... 198 40 843

(51) Int. Cl.[7] ..... B63H 3/00
(52) U.S. Cl. ..... 416/31; 416/157 R; 416/205
(58) Field of Search ..... 416/31, 36, 40, 416/155, 157 R, 205

(56) References Cited

FOREIGN PATENT DOCUMENTS

| | | |
|---|---|---|
| 2552529A1 | 6/1977 | (DE) . |
| 2807899 | 8/1978 | (DE) . |
| 8406829 | 8/1984 | (DE) . |
| 8815383 | 3/1989 | (DE) . |
| 4438995A1 | 8/1995 | (DE) . |

*Primary Examiner*—Edward K. Look
*Assistant Examiner*—Hermes Rodriguez
(74) *Attorney, Agent, or Firm*—Evenson, McKeown, Edwards & Lenahan, P.L.L.C.

(57) ABSTRACT

A fan impeller assembly of simple construction which is intended, in particular, for use in cooling systems of internal combustion engines and can be used there inter alia as a cleaning blower for clearing the radiator and/or corresponding air inlet openings by reversal of the direction of delivery.

22 Claims, 7 Drawing Sheets

FAN IMPELLER ASSEMBLY FOR COOLING SYSTEMS OF INTERNAL COMBUSTION ENGINES

BACKGROUND AND SUMMARY OF THE INVENTION

This application claims the priority of German application 198 40 843.9, filed in Germany on Sep. 7, 1998, the disclosure of which is expressly incorporated by reference herein.

The invention relates to a fan impeller assembly, in particular a fan impeller which can be used in the cooling system of internal combustion engines. Preferred embodiments of the present invention relate to a fan impeller assembly for cooling systems of internal combustion engines, comprising: a cup shaped hub, adjustable fan blades which are guided rotatably in a peripheral wall of the hub, and an actuating drive operable to adjust the fan blades and situated in the cup-shaped hub, said actuating drive including: an actuating element spring-loaded toward an initial position and acted upon in an opposite direction by a pressure medium, and adjusting eccentrics which are situated at a transition between said actuating element and the fan blades and can be acted upon by the actuating element, the actuating element being formed by a concentrically arranged actuating piston which adjoins the cup wall in a sealing manner and is guided by the latter.

In the case of a known fan impeller of the abovementioned type (DE-A 28 07 899) with a cup-shaped hub, the fan blades are mounted in the cup wall and, at an axial offset therefrom, the hub forms the holder and sealing guide for an actuating piston which can be loaded by means of pressure medium, is supported resiliently in the opposite direction and acts as an actuating element for the fan blades. The adjusting eccentrics assigned to the fan blades are formed by pivoting levers which extend in the circumferential direction, are connected to the fan blades in a rotationally rigid manner within the hub and are acted upon by means of axially extending actuating rods which are supported against the piston. Although a configuration of this kind allows relatively large piston diameters, the axial offset of the piston relative to the fan blades leads to a relatively large overall depth of the hub, even in the case of relatively small pivoting angles for the fan blades, and also involves relatively high outlay on construction.

Other known publications relating to the technical background are DE 88 15 383 U1, DE 84 06 829 U1, DE 25 52 529 A1 and DE 44 38 995 A1.

The invention relates to the configuration of a fan impeller of the type stated at the outset and has the object of arriving at a basic design of fan impeller which is of simple, small and flat construction and allows such a fan, the direction of delivery of which can be reversed while the direction of rotation remains the same, to be used in existing designs instead of conventional blower impellers. This object is achieved according to preferred embodiments of the invention by providing a fan impeller assembly of the type referred to above, wherein a piston wall of the actuating piston lies in radial overlap with the fan blades as an actuating ring for receiving actuating stubs of the adjusting eccentrics, and wherein, by a pressure medium acting on the actuating piston, the fan blades can be changed over into a direction of delivery opposite to a direction of delivery in an initial position and, in both of the opposite directions of delivery, are loaded in the directions of the blade position corresponding to the respective direction of delivery.

By virtue of the fact that an axially displaceable actuating piston is used, the operation of the actuating piston is independent of the respective speed and its surface area can be dimensioned in such a way, based in particular on the respective size of the hub, that sufficiently high actuating forces are obtained even at low actuating pressures. This configuration furthermore provides the possibility of creating sufficient space for an elastically flexible return device of simple configuration, with the result that, overall, an actuating device is created in which active adjustment takes place in each case in only one direction of actuation and in which the return is accomplished by means of the passive elastically flexible return device, which operates against the actuating force of the pressure-loaded actuating piston. This makes it possible to obtain an actuating device in which pressure loading is necessary in only one direction and the change-over can be accomplished by switching the pressure loading on and off. If a pump, a compressor, an accumulator or the like is provided for the purpose of pressure loading, there is thus no need for any further control devices but only for the pressure source to be switched on and off. With a view to as compact as possible an axial overall length, an axially overlapping arrangement of the actuating piston and the fan blades is of particular and independent significance.

Particularly in the case of pneumatic actuation, this leads to a very simple solution, making possible a basic concept such that the end position which is adopted by means of the elastically flexible return device corresponds to a normal working position of the fan impeller as the forward-blowing direction. There is therefore no need for any pressure supply in the normal working position, maximum reliability of operation is thus ensured and, moreover, a very energy-saving operation is made possible if, upon pressure loading, only a brief working position is adopted as the reverse blowing direction. This can be accomplished simply by switching on a pump or a compressor, especially as the large-area dimensioning allows operation at very low pressures.

Particularly in connection with pneumatic actuation of the actuating device, it is possible, if the source of compressed air is switched on only briefly to build up the required actuating pressure and then switched off, for the change-over from the reverse blowing position as the brief working position to the normal working position as the forward-blowing position to be achieved simply by carrying out the pressure reduction in a delayed or time-controlled manner.

This can be achieved in a particularly simple manner if the volume closed off by the actuating piston is connected, for example, to atmosphere by a restrictor opening, if required in a controlled manner.

By virtue of the fact that, in the case of the solution according to the invention, the fan blades are loaded in their respective end position by a holding force which is independent of the actuating device and acts in the direction of the end position, in particular by the force of the air resistance acting on the fan blades, it is possible, in conjunction with a time-controlled pressure reduction as explained above, to design the actuating device in such a way that a virtually immediate change-over between the two end positions is obtained, not only when changing over from the normal working position into the brief working position but also when changing over in the opposite direction. This is because, with such a configuration, the actuating force supplied by the elastically flexible return device can be dimensioned in such a way in relation to the self-holding force that it is only slightly greater than the self-holding force, allowing a virtually complete pressure reduction to be formed before the change-over takes place, the change-over then taking place abruptly since there is no significant opposing force being exerted by the actuating piston once the self-holding force has been overcome, due to the pressure reduction which has taken place. The use of the force of the air resistance acting on the fan blades as a holding force represents a particularly advantageous solution.

As regards the switching time, switching from the normal working position to the brief working position is essentially dependent only on the delivery capacity of the pressure source or a corresponding reservoir volume acting as a source of supply.

The configuration of a fan impeller with adjustable fan blades and with a holding force, as the self-holding force, in their respective end position which is independent of the actuating device and acts in the direction of the end position also proves essential as regards stabilization of the fan blades in their respective end position and hence for reliable operating behavior since, in this way, it is possible without additional expenditure to achieve a stable end position in which the blades do not flutter and the blades assume a virtually fixed position relative to the hub despite their adjustability. Moreover, this effect can be achieved without additional expenditure if, in accordance with the invention, the fan blades are loaded in the direction of the respective end position by the force of the air resistance acting upon them counter to the direction of delivery.

The construction of the eccentric mechanism with a common actuating ring formed by the cylindrical wall part of the actuating piston in conjunction with the radial orientation and mounting of the fan blades in the hub housing and the axial overlap with the actuating piston leads to a particularly simple and flat construction in accordance with the invention.

As seen radially from the outside, the fan blades are each curved in a direction opposite to the direction of delivery, resulting in section in a convex fan blade curvature counter to -the direction of delivery, that end of the respective blades which projects forwards in the direction of delivery having a predominantly axial orientation, and the rearward end relative to the direction of delivery having a largely radial orientation.

For the change-over between the directions of delivery, rotation of the blades about their respective centre line has been found to be expedient, more particularly at an angle of, preferably, more than 90°, in particular at an angle of the order of about 110°, it being possible to influence the magnitude of the self-holding force both by means of the shape of the blade profile and/or the angle of incidence and/or the axial distance of the respective blade edge at the front in the direction of delivery from the axis of rotation of the fan blade.

The basic concept according to the invention of a fan impeller with adjustable fan blades furthermore makes it possible as an optional additional function, while retaining the principle of construction and in accordance with the invention to perform speed- and/or temperature-dependent adaptation of the cooling performance in order to reduce the cooling performance, which, in principle, rises with the speed in the case of a predetermined rigid ratio between the speeds of the crank shaft and the fan impeller, if there is no need for such cooling performance. In the case of a fan impeller according to the invention, this is achieved by virtue of the fact that the spring-loaded initial position of the actuating piston is stop-limited counter to the spring force and the position of the limiting stop is varied as a function of the speed and/or temperature.

The starting point here is that, for a large number of applications, especially for machines such as agricultural and stationary machines and also commercial vehicles and utility vehicles and, in this context, especially agricultural utility vehicles such as tractors, the internal combustion engine is generally operated within a relatively narrow working range and there is thus no need for continuous adjustment of the fan blades. The working range mentioned is generally a range in which the internal combustion engine is below its maximum speed and in which the cooling performance requirement is high, in particular at a maximum, based on the maximum torque that can be achieved in this range or maximum power that can be achieved in this range. Starting from this range, the air delivery rate and cooling performance that can be achieved thereby generally increases more steeply with increasing speed than the respective maximum cooling performance requirement. This can be allowed for by the configuration according to the invention by adjusting the angle of incidence of the fan blades—so as to reduce the cooling performance—in the direction of a lower air delivery rate, and this can be accomplished directly as a function of the speed.

Such speed-dependent adjustment can be achieved—as an independent inventive solution—by means of the actuating force resulting from the force acting on the fan blades as a function of the air resistance, this force increasing with speed with the result that, based on the maximum cooling performance requirement for the working range mentioned, it is possible to perform adjustment where the air-resistance-dependent actuating force is in equilibrium with an elastically flexible support. If this working range is exceeded, i.e. if the speed is increased further, a correspondingly higher air-resistance-dependent actuating force is obtained in line with the increased speed, and the fan blades are pivoted to a smaller angle of incidence against the elastic support, it being expedient to delimit the permissible minimum angle of incidence by means of a fixed stop.

Within the context of the invention but also as an independently inventive solution, a corresponding adaptation can also be achieved as a function of temperature. This is possible by virtue of the fact that a stop element operating in a temperature-dependent manner is configured in such a way that a maximum deflection is obtained when the internal combustion engine is operating at a corresponding speed in the working range mentioned of maximum loading and maximum cooling performance requirement. If the speed goes beyond this, the rise in the cooling performance requirement lags behind the rise in speed, with the result that the temperature falls as a consequence of the increase in the air delivery rate and cooling performance against speed, this leading to a reduction in the deflection of the stop element which operates in a temperature-dependent manner and an adjustment of the fan blades in the direction of a smaller angle of incidence and a correspondingly lower air delivery rate by means of the air-resistance-dependent actuating force loading them.

According to the invention, this provides a solution which operates in a speed- and/or temperature-dependent manner and by means of which the power requirement of the fan impeller is reduced in the critical upper speed ranges to the level required to cool the internal combustion engine, thus reducing the power losses of the internal combustion engine, with correspondingly positive effects on the effectively available power of the internal combustion engine and on fuel consumption.

The temperature-dependent adjustability according to the invention, if required in combined form to give temperature- and speed-dependent adjustability, furthermore provides the assurance that there will be no deficit in cooling performance in the case of a higher cooling performance requirement in the speed range above said working range since, given an elevated temperature and a corresponding retroactive effect on the temperature-dependently operating stop element, the angle of incidence of the fan blades even in the speed range above, i.e. beyond, the working range mentioned can be adjusted or can be set to an angle of incidence which corresponds to the maximum delivery rate if the temperature-dependently operating stop element is designed in such a way that it can also withstand higher air-resistance-dependent actuating forces occurring as a function of the speed.

Springs, in particular helical springs, can be used as elastic stop elements, and expandable-material elements, in particular, can be used as temperature-dependent stop elements.

Other objects, advantages and novel features of the present invention will become apparent from the following detailed description of the invention when considered in conjunction with the accompanying drawings.

DETAILED DESCRIPTION OF THE DRAWINGS

Figure 1:
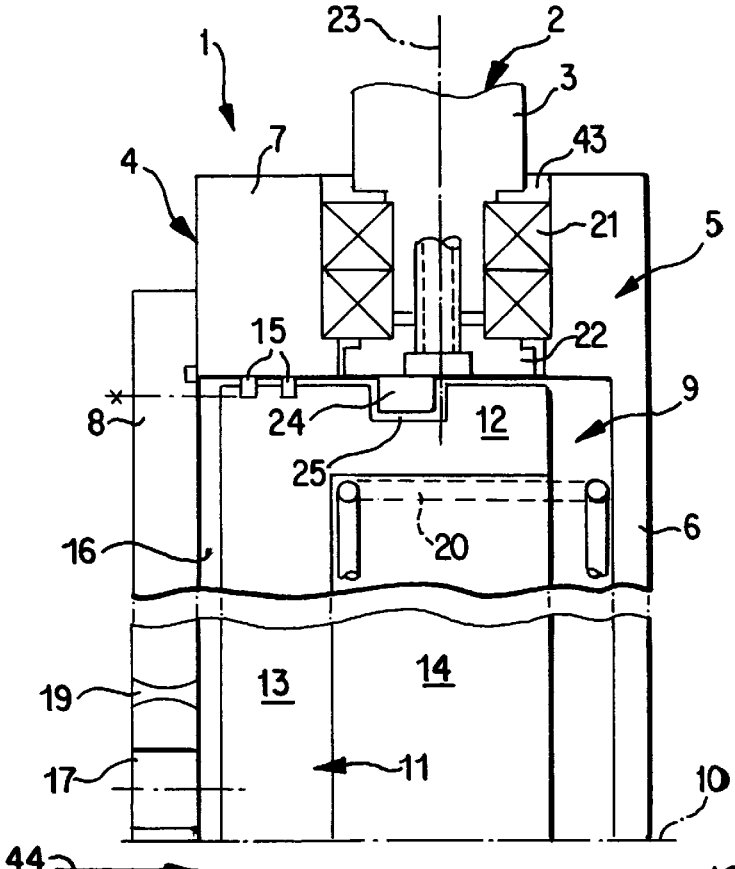
FIG. 1 shows half of the hub of a fan impeller in accordance with the invention in a schematized sectional representation, the section plane being a radial plane through the mounting of a fan blade, with a first embodiment of an actuating device for turning the fan blade.

The illustration in FIG. 1 shows part of a fan impeller assembly 1, of whose fan blades 2 only one, with its radially inner, hub end connecting part 3, being shown, the hub which receives this connecting part 3 being shown schematically in section and being denoted overall by 4. The hub 4 comprises a cup-shaped hub body 5 which comprises a bottom part 6 and the cup wall 7, the cup wall 7, which serves as the peripheral wall of the hub body 5, being covered opposite the bottom part 6 by a cover 8, with the result that the hub 4 has an interior space 9 bounded by the bottom part 6, the cup wall 7 and the cover 8. If the hub 4 is of concentric construction with respect to the axis of rotation 10 of the hub 4, the connection of which to the shaft supporting it is not illustrated specifically here, the interior 9 of the hub accommodates an actuating piston 11 which comprises a cylindrical piston wall 12, adjacent to the cup wall 7, and a piston end 13, the piston wall 12 and the piston end 13 delimiting the piston interior 14, which is open toward the bottom part 6 of the hub 4. On the opposite side, the piston end 13 of the actuating piston 11, which is sealed off relative to the cup wall 7 in the region of the piston end 13 by ring seals 15, delimits a working space 16, which can be connected by means of a supply opening 17 to a pressure source, which is not shown specifically here. Arranged in the cover 8 there is furthermore an outflow opening 19 which, within the context of the invention, is constructed as a restrictor hole. In the direction of the cover 8, the actuating piston 11 is loaded in an elastically flexible manner, this support being provided, in the embodiment example shown in FIG. 1, by a helical spring 20 acting as a supporting element, the diameter of which corresponds approximately to the diameter of the piston interior 14 accommodating it.

With their root portion acting as connecting part 3, the fan blades 2 are rotatably mounted in that part of the cup wall 7 which is axial to the piston wall 12 and radially overlaps it, the relevant bearings being indicated only schematically and denoted by 21 in the embodiment example. A cap part 22 is connected in a rotationally rigid manner and under axial preload to the connecting part 3 lying opposite the latter in relation to the bearings 21, and this cap part, for its part, comprises an actuating stub 24 which lies eccentrically with respect to the axis 23 of the bearings 21 and of the respective fan blade 2 and engages in a recess 25 which is provided in the piston wall 12 and can be designed as a location hole, in particular as a pocket hole that guides the actuating stub 24 or else as a slotted guide extending in the circumferential direction of the piston.

If the working space 16 is subjected to pressure, the piston 11 is displaced axially against the force of the spring 20, and this translatory movement is associated with a pivoting movement of the actuating stub 24 about the bearing axis 23, with a corresponding rotation of the fan blade 2 about this axis, a rotation of the piston 11 about the axis of rotation 10 being superimposed on the pivoting movement for the actuating stub 24 when the latter is received in a pocket hole. If the recess is designed as a slotted guide extending in the circumferential direction, the actuating stub can be displaced in the circumferential direction relative to the piston.

Figure 2:
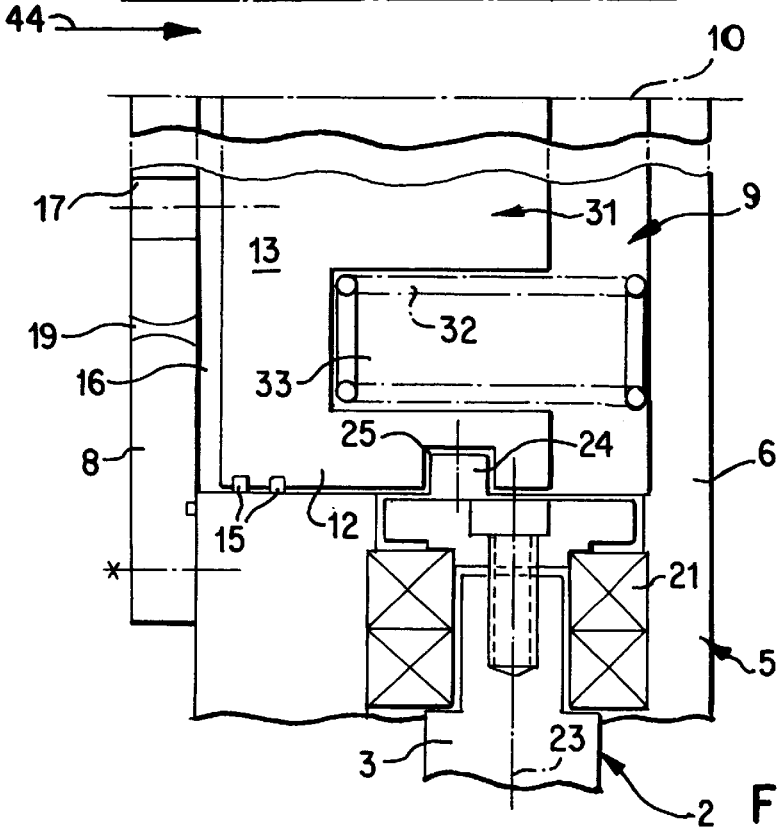
FIG. 2 shows a sectional representation corresponding to FIG. 1 through a corresponding fan impeller with the actuating device configured according to a different embodiment.

The embodiment example in accordance with FIG. 2 corresponds to a very large extent to that in accordance with FIG. 1. Accordingly, the same reference numerals are used for identical parts.

However, the actuating piston denoted by 31 in this embodiment example is assigned a plurality of helical springs 32 distributed over its circumference as elastically flexible supports—supporting elements—and, when supported against the bottom part 6 of the cup-shaped hub body, these supporting elements are each guided in a recess 33 provided in the rear side of the actuating piston 31.

Figure 3:
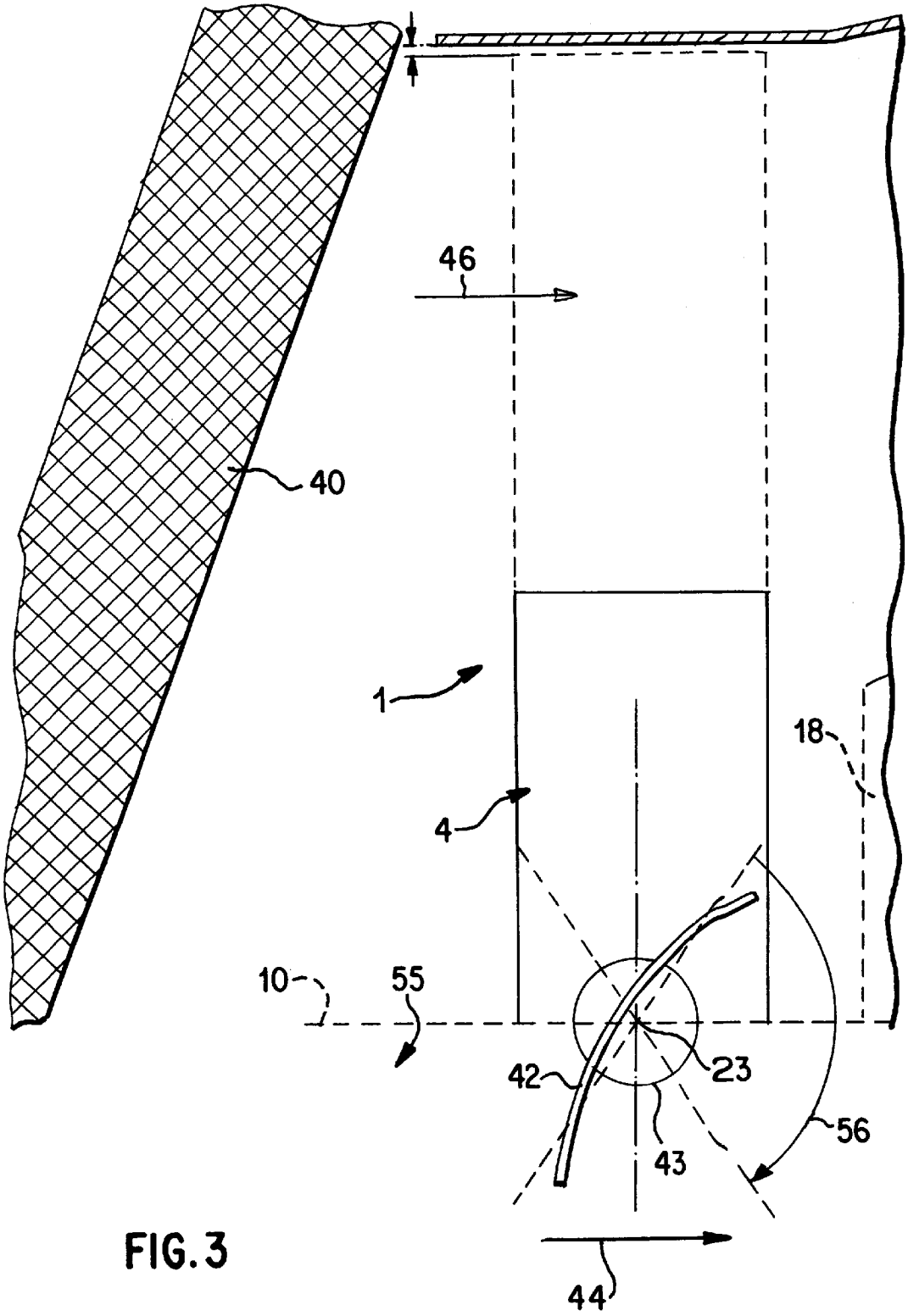
FIG. 3 shows a schematized representation of the fan impeller in accordance with the invention in a simplified radial view with the fan blade shown at the vertex.
Figure 4:
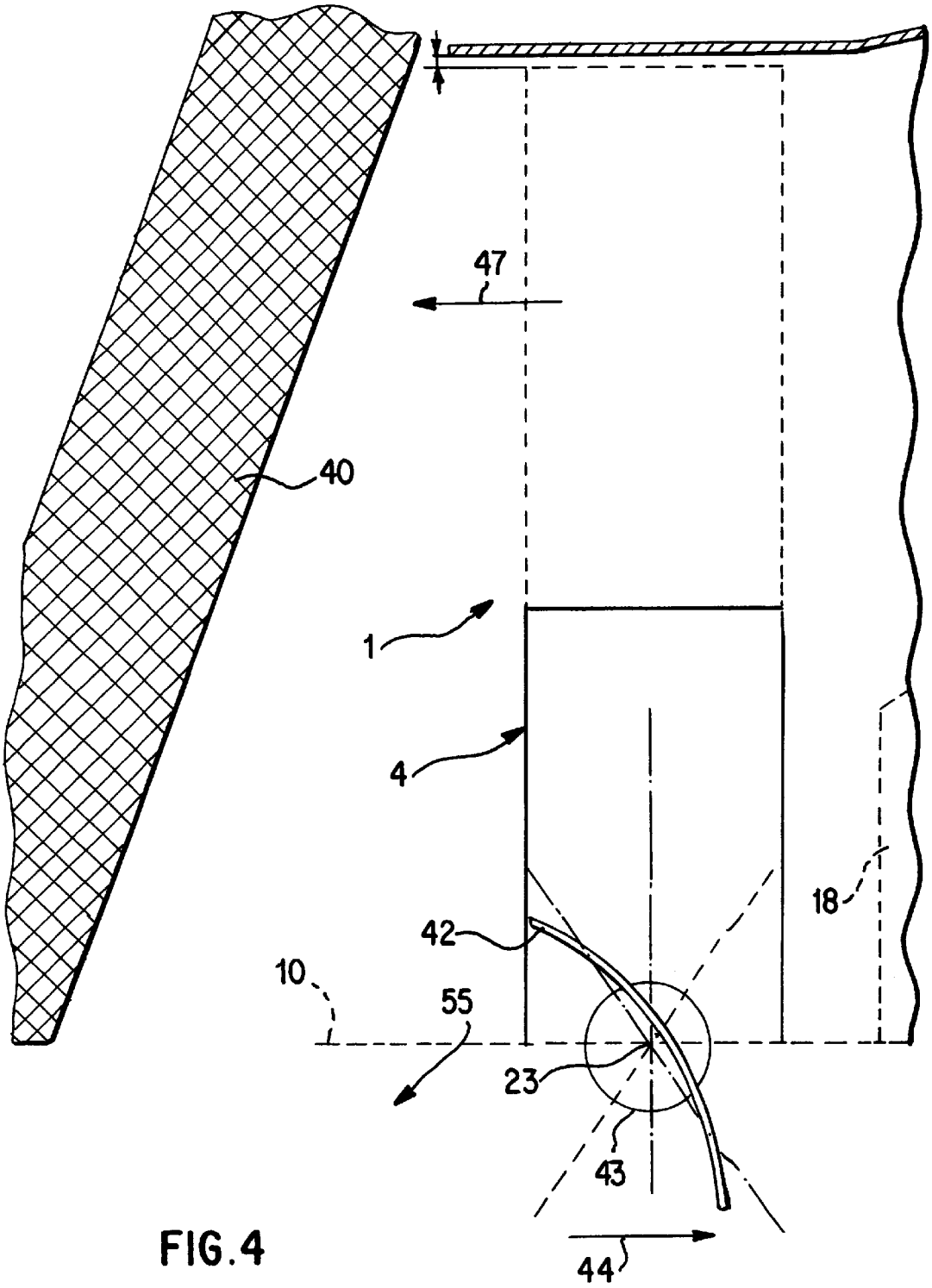
FIG. 4 shows a representation corresponding to FIG. 3 showing a position of the fan impeller for delivery in the opposite direction.
Figure 5:
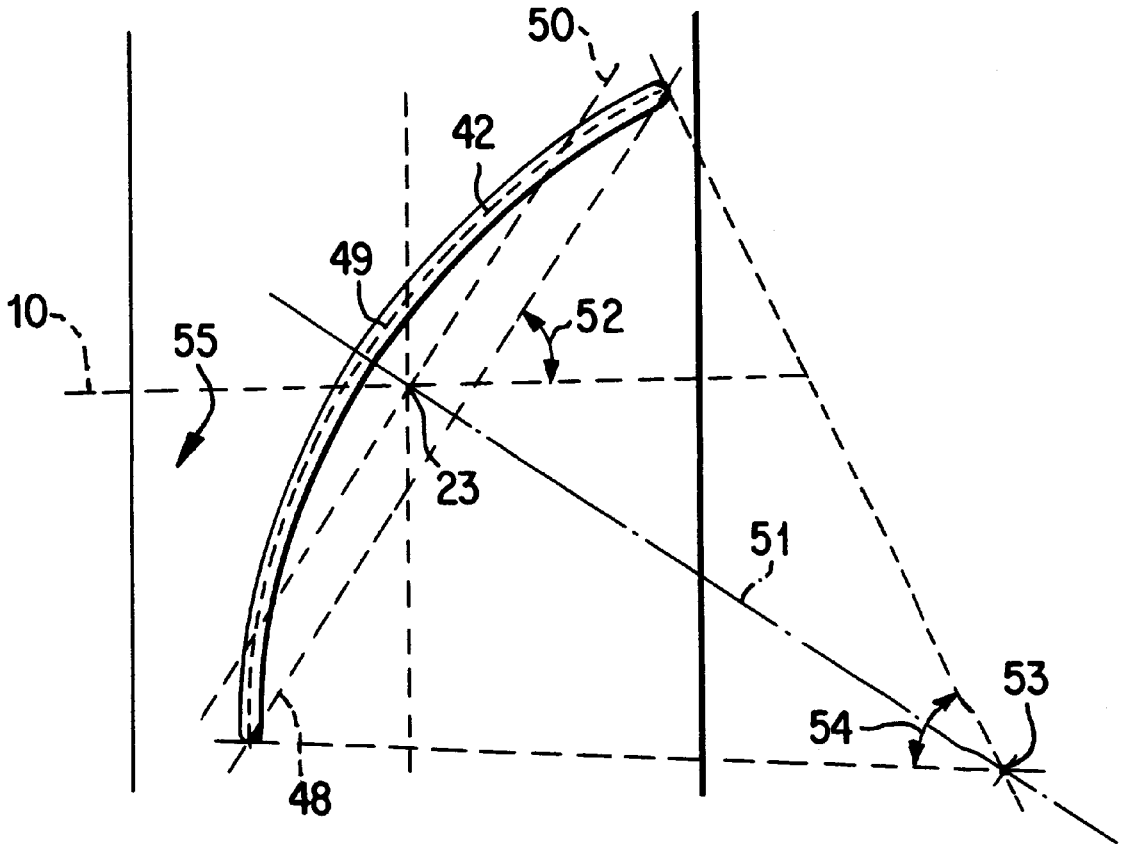
FIG. 5 shows a schematized representation of a fan blade in a position and embodiment corresponding to FIG. 3.

The embodiment examples in accordance with FIGS. 3 and 4 show, in highly schematized form, the arrangement of the fan impeller 1 relative to the radiator of an internal combustion engine 18, which is merely indicated, this radiator being denoted by 40 and only one fan blade 42 being shown in each case for the respective fan impeller 1. This is the fan blade 42 which, relative to its axis of rotation 23, lies in a plane perpendicular to the plane of the drawing and containing the axis of rotation 10 of the fan impeller 1 in the view shown, with the result that the location hole 43 provided in the cup wall 7 for the purpose of holding the connecting part 3 of the respective fan blade 42 is symmetrical with respect to this plane.

Starting from an installed position of the hub 4 corresponding to that shown in FIGS. 1 and 2 in the configuration shown in FIGS. 3 and 4, the actuating piston 11 in accordance with FIG. 1 or 31 in accordance with FIG. 2, which is not shown specifically in FIG. 4, can be subjected to pressure in the direction of arrow 44, i.e. away from the radiator 40, and hence can be displaced counter to the elastically flexible return device formed by the spring 20 or springs 32—each acting as supporting elements. A corresponding displacement entails the movement of the fan blade out of the position shown in FIG. 3 into a position shown in FIG. 4. The position shown in FIG. 3 corresponds to a direction of delivery of the fan impeller 1 as indicated by arrow 46, with the result that air is drawn in through the radiator 40.

If the actuating piston 11 or 31 is subjected to pressure, the axial displacement of the actuating piston 11 or 31 is associated with a rotation of the actuating stub 24 about the respective bearing axis 23 of the associated fan blade and hence, owing to the rotationally rigid connection between the eccentric actuating stub 24 and the respective fan blade, with a rotation of the fan blade.

Corresponding to the possible axial end positions of the actuating piston 11 or 31, there are also two resulting end positions for the fan blade 2 of the fan impeller 1, these end positions being shown for the fan blade 42 in FIGS. 3 and 4, FIG. 4 showing the end position which corresponds to the piston being subjected to pressure and displaced against the elastically flexible support. In the end position shown in FIG. 4, the fan blade 42 is set in the opposite direction to that in the illustration in FIG. 3, with the result that air is now delivered in the direction of the radiator 40 (arrow 47).

The axial displacement travel of the actuating piston 11 or 31 is dimensioned so that, by virtue of the interaction of the eccentric actuating stub 24, it results in a rotation (arrow 56) of the fan blade 42, in the embodiment example a rotation through 110°, the fan blade 42 assuming, in its two end positions, a symmetrical position with respect to the plane of symmetry through the axis of rotation 23 of the fan blade 42, this axis being perpendicular to the axis of rotation 10 of the fan impeller 1. In the embodiment example, the delivery behavior of the fan impeller 1 is accordingly the same in both directions of delivery, arrows 46 and 47.

Even if an angle of 110° is particularly advantageous, and an angle of 110° proves particularly advantageous particularly with the blade configuration described, especially in the case of arched blade cross sections, the angle of rotation for the fan blades 42 can also be smaller, it being possible according to the invention also to achieve angles of less than 90°, for instance of 70–90°, particularly when a lower delivery rate is accepted in one direction of delivery than in the other direction, something which may in some cases also be intended: thus, for example, in the context of the invention, if a particularly high delivery rate is desired for the brief working position in order, for example, in the case of soiling of the radiator 40, to achieve rapid clearing, but the delivery rate required for the normal working position is relatively low.

Based on the embodiment example shown and the plane of symmetry discussed, the fan blades 42 are each arched counter to the respective direction of delivery, the arc 49 formed by the fan blade 42 and the chord 48 connecting the ends of the fan blades describing a circular segment, the chord 48 of which extends at an angle 52 of about 50–60°, in the embodiment example about 55°, to the direction of delivery parallel to the axis of rotation 10. Relative to the axis of rotation 23 of the respective fan blade 42 and a straight line running parallel to the chord 48 and through the axis of rotation 23, the chord 48 and the arc 49 of the fan blade 42 are situated on different sides of the straight line 50 running through the axis of rotation 23, the fan-blade width given by the chord 48 corresponding essentially to the radius of curvature of the blade. The center of curvature 53 of the arc 49 here lies on a straight lines 51 running perpendicular to the chord 48 and through the axis 23 with respect to which the arc 49 is symmetrical. In the embodiment example, the angle 54 at the circumference of the arc 49 is between 55 and 75°, preferably about 65°.

The configuration described for the fan blade 42 makes it possible in a simple manner, i.e. without additional mechanical complication, to achieve a self-holding effect based on the air resistance acting on the fan blade 42 for both end positions and for a constant direction of rotation 55 of the fan impeller 1, irrespective of the position of the fan blade 42. In both end positions, the fan blade 42 is loaded in the direction of the end position by the air resistance. In the context of the solution according to the invention, there is accordingly no need for any other special means of retaining this end position, e.g. to prevent fluttering of the blades.

According to the invention, this makes it possible to obtain a fan blade 1 in which the actuating piston 11, 31 of the actuating device is loaded only by the elastically flexible return device formed by the spring 20 or the springs 32 in the forward-blowing direction 46, which corresponds to the normal operating position. High preloading forces are not required here since the blades 2 or 42 are also urged into the position shown in FIG. 3 and corresponding to this normal operating position by the air resistance acting upon them, with the result that no fluttering movements of the fan blades arise.

If the actuating piston 11 or 31 is subjected to pressure, only a low actuating pressure is required for the solution according to the invention, in which the actuating piston 11 or 31 is subjected to axial pressure and has an impingement area which largely corresponds to the hub area and is therefore very large, and the system can therefore be operated with low pressure. When subjected to pressure, the piston 11 or 31 is displaced against the elastically flexible support (springs 20, 32), and the fan blades 42 thus reach a position shown in FIG. 4 in which the fan blows in the direction of the radiator 40 (rearward blowing direction 47 or brief working position).

If it is assumed that this working position is to be maintained for only a short period compared with the normal working position, the operating time under such pressure is also shorter than the normal operating time, and the energy consumption of such a system is lower than in systems which require corresponding active pressurization to maintain at least one of their end positions.

If the pressurization, which can be performed (although not shown specifically here) by means of a pump or a compressor by switching it on, or by connection to a low-pressure reservoir system, is interrupted, pressure reduction takes place by outflow of the air via the outflow opening 19, which, when designed as a restrictor opening, offers the possibility of performing the pressure reduction in a time-controlled manner as a function of the restrictor cross section.

If the fan blades are also acted upon by means of the air resistance in the direction of their end position corresponding to the brief working position, the corresponding end position can be maintained during the period of pressure reduction in the solution according to the invention since the self-holding effect counteracts the restoring force acting via the elastically flexible support. Assuming corresponding matching of this restoring force to the self-holding force, very extensive pressure reduction is thus possible before the change-over movement takes place, with the result that the change-over can take place virtually immediately as is possible with the change-over in the opposite direction under pressurization.

The restrictor can be assigned a shut-off valve, whether this is arranged upstream, downstream or integrated into the restrictor, so that the holding duration of the pressure in the working chamber can be determined by means of this valve and hence independently of the connection of the working chamber to the pressure source, as soon as the pressure required for the change-over to the brief working position has been built up in the working chamber.

Hydraulic actuation of the actuating piston is expedient and advantageous, particularly in conjunction with such a configuration, especially with hydraulic actuation in many cases such as in the case of tractors, where already existing hydraulic systems and their pressure supply can be used.

The invention provides an actuating device for a fan impeller which makes it particularly expedient to use such a fan impeller in the cooling system of internal combustion engines, particularly when the brief working position involving reversal of the delivery direction compared with the normal operating position is to be used to clear the radiator or the inflow path to the fan impeller by reversing the direction of flow relative to the direction of air flow in the normal working position. In this connection, see FIG. 9.

By virtue of the fact that the solution according to the invention also allows an abrupt change-over from the brief working position to the normal working position, the normal working mode of the fan impeller and hence the normal cooling mode is interrupted only briefly, thereby preventing overheating of the engine.

The change-over to the brief working position for purposes of cleaning can take place automatically as a function of the air resistance or other suitable parameters, such as changes in the coolant temperature and the like, or manually, all that is required in each case being to switch on the pressure source briefly in order to perform the change-over to the brief working position. Accordingly, the energy required for the operation of the fan impeller according to the invention is also extremely low, especially because, as explained, the change-over in the opposite direction is performed without active actuating devices.

Figure 6:
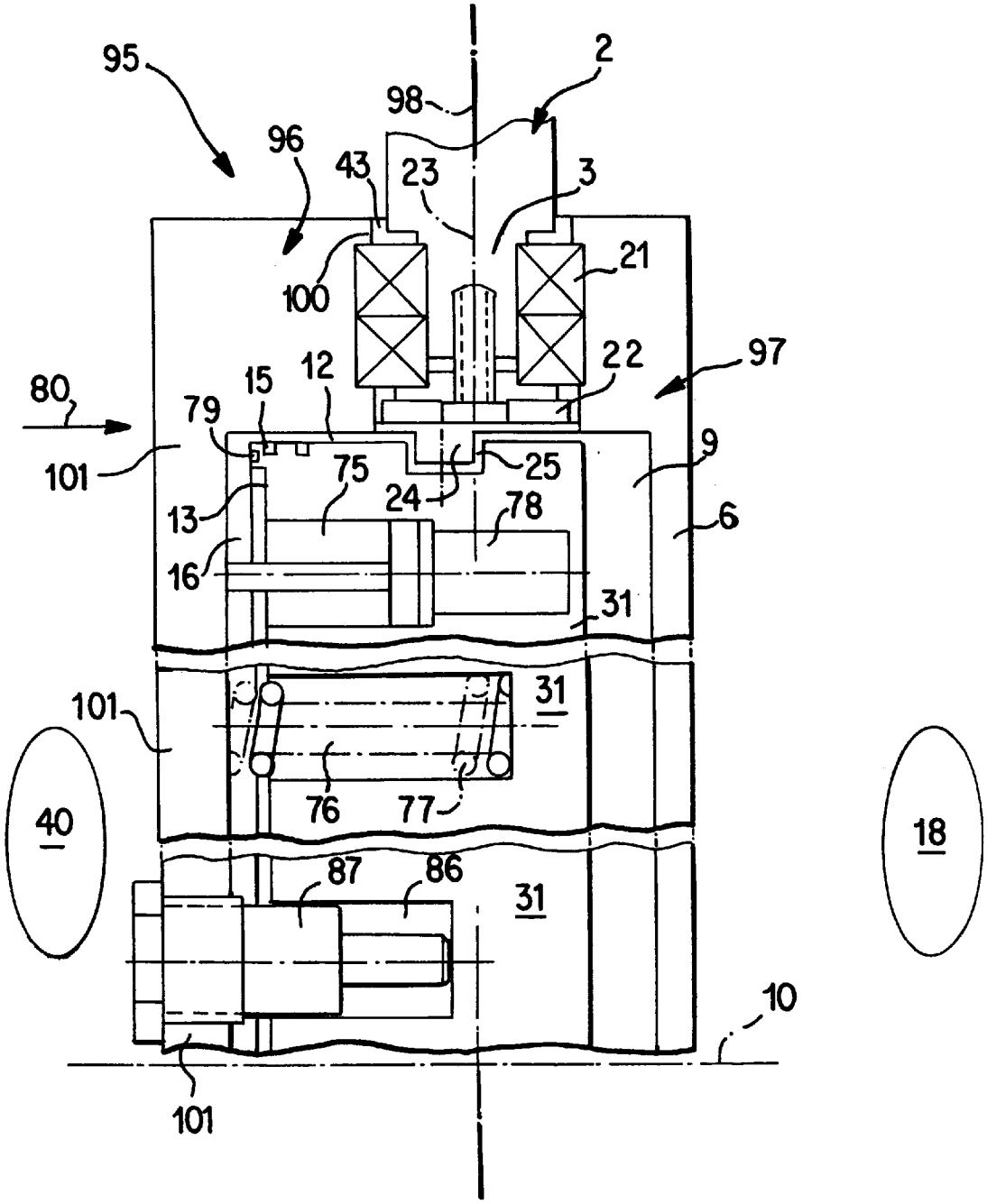
FIG. 6 shows a representation similar in basic construction to FIG. 2, in which the spring-loaded initial position is assured by a variable-position limiting stop, which is secured by elastic and/or temperature-dependent variable-position supporting elements.

Another configuration of the invention is shown in FIG. 6, the illustration showing a similar basic construction to that in FIG. 2 and using corresponding reference numerals. As a departure from the previous examples, the hub 95 is constructed from two coaxial hub parts 96 and 97, the axes 23 of the fan blades 2 lying in the parting plane 98, allowing the bearings 21 to be inserted into the location hole 43 in the hub 95 as the hub parts 96 and 97 are assembled and to be fixed there axially by radial collars 100 provided at the ends, this leading to a simple overall construction which is advantageous for assembly.

As in FIG. 2, the actuating piston 31 provided can be subjected to pressure medium on the working-space 16 side and is spring-loaded into its illustrated initial position, as indicated by means of the helical spring 32 in FIG. 2. As a departure from the representation in FIG. 2, the actuating piston 31 is provided with location openings 75, 76, 86 which start from the working space, start as pocket holes from the end 13 of the piston and in which stop elements 77, 78 and 87 respectively, which are supported against the bottom 101 of the cup part 96, can be arranged singly and/or in combination. Stop element 77 is formed by a supporting spring and stop element 78 is formed by an expandable-material element, as is commercially customary. Both stop elements 77, 78 are assigned to the piston 31 and guided in the associated location opening 75, 76. Stop element 87, which is likewise designed as an expandable-material element, is secured in the bottom 101 of the cup part 95, in particular screwed in, and engages in the location opening 86. If required, that part of expandable-material element 87 which is subjected to heat can also be arranged so as to project further in the direction of the radiator 40. In the context of the invention, it is also possible to use a bimetallic spring or a bimetallic spring assembly as a stop element, if required, but this is not shown here.

The stop elements 77, 78, 87 form limiting stops whose position changes as a function of speed or temperature and on which the piston 31 is supported in the direction opposite to the helical spring 32 (FIG. 2) as an elastically flexible supporting element, the piston 31 having a rim 79 which acts as a fixed stop when it is resting on the bottom 101.

Figure 7:
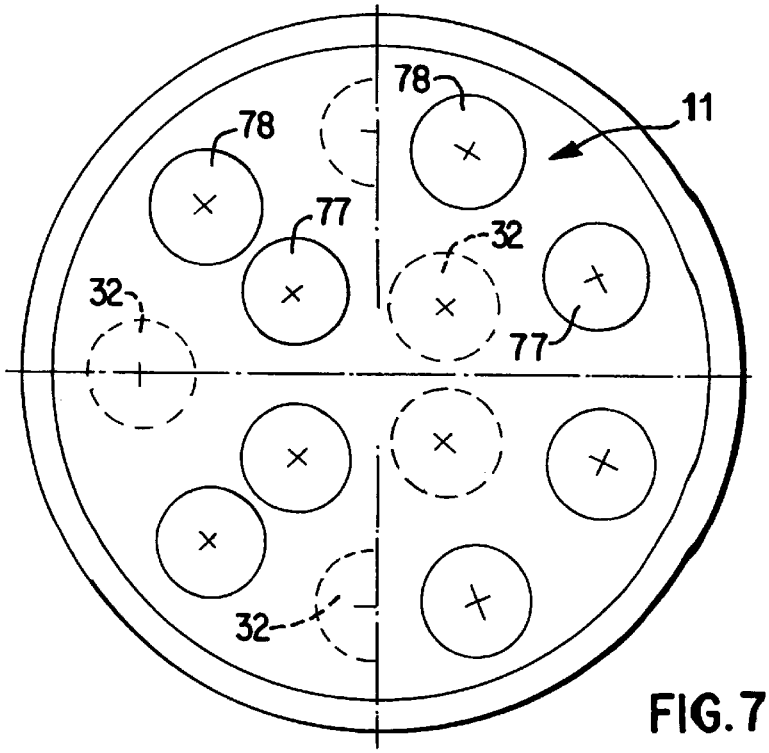
FIG. 7 shows a highly schematized and simplified representation of an actuating piston assigned to the actuating device, in which the position of the helical springs acting on the piston and employed as elastically flexible supports and of the stop elements acting in the opposite direction is illustrated.

FIG. 7 shows, in a schematic representation of the actuating piston 31 when the latter is viewed in the direction of arrow 80 in FIG. 6, arrangements that are possible by way of example for stop elements, as indicated symbolically for stop elements 77, 78 and the helical springs 32 acting in the opposite direction, the configuration shown on the left in FIG. 7 indicating a radially staggered arrangement of the stop elements 77 and 78, while the illustration on the right shows them arranged offset in the circumferential direction. Given these arrangements, it proves expedient to place the resilient support acting from the opposite side and symbolized by the helical spring 32 in a gap, on the left-hand side of the figure close to the piston wall, for example, and on the right-hand side of the figure close to the centre. In this way, it is possible to achieve uniform piston support from both sides of the piston, thus ensuring that the piston is not subjected to any tilting forces.

Figure 9:
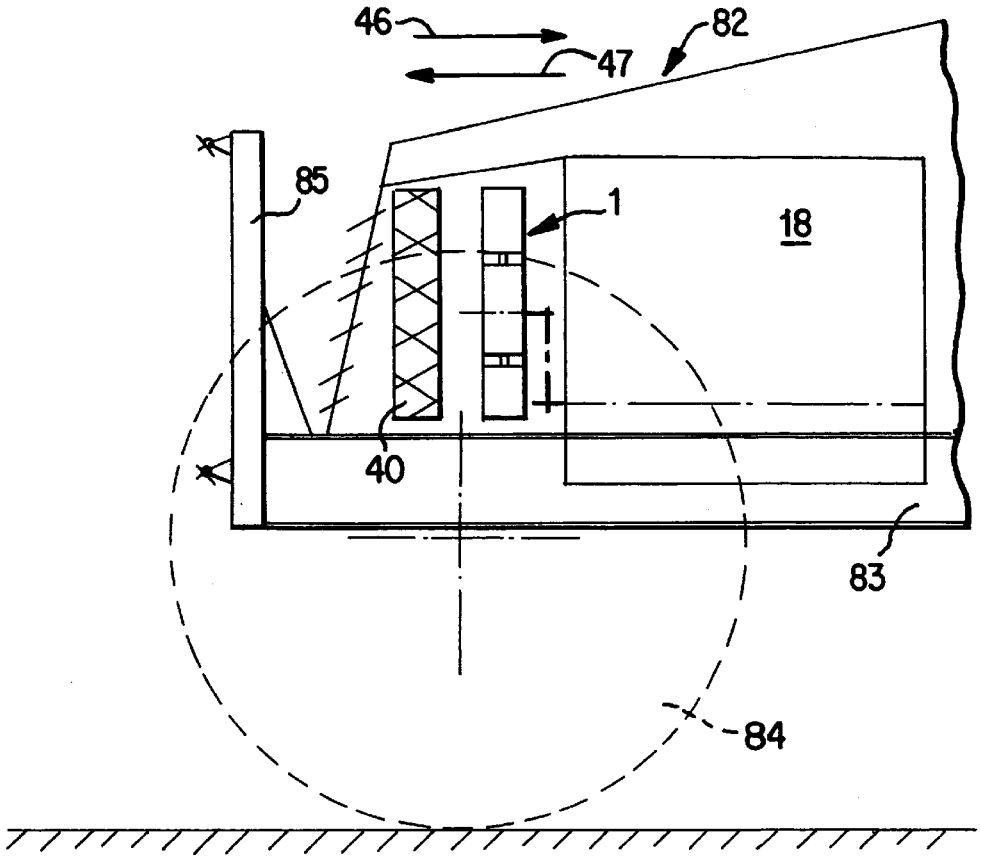
FIG. 9 shows a highly schematized representation of the front area of a tractor in side view, the emphasis being essentially on the arrangement of the internal combustion engine and of the cooling system associated with it.
Figure 8:
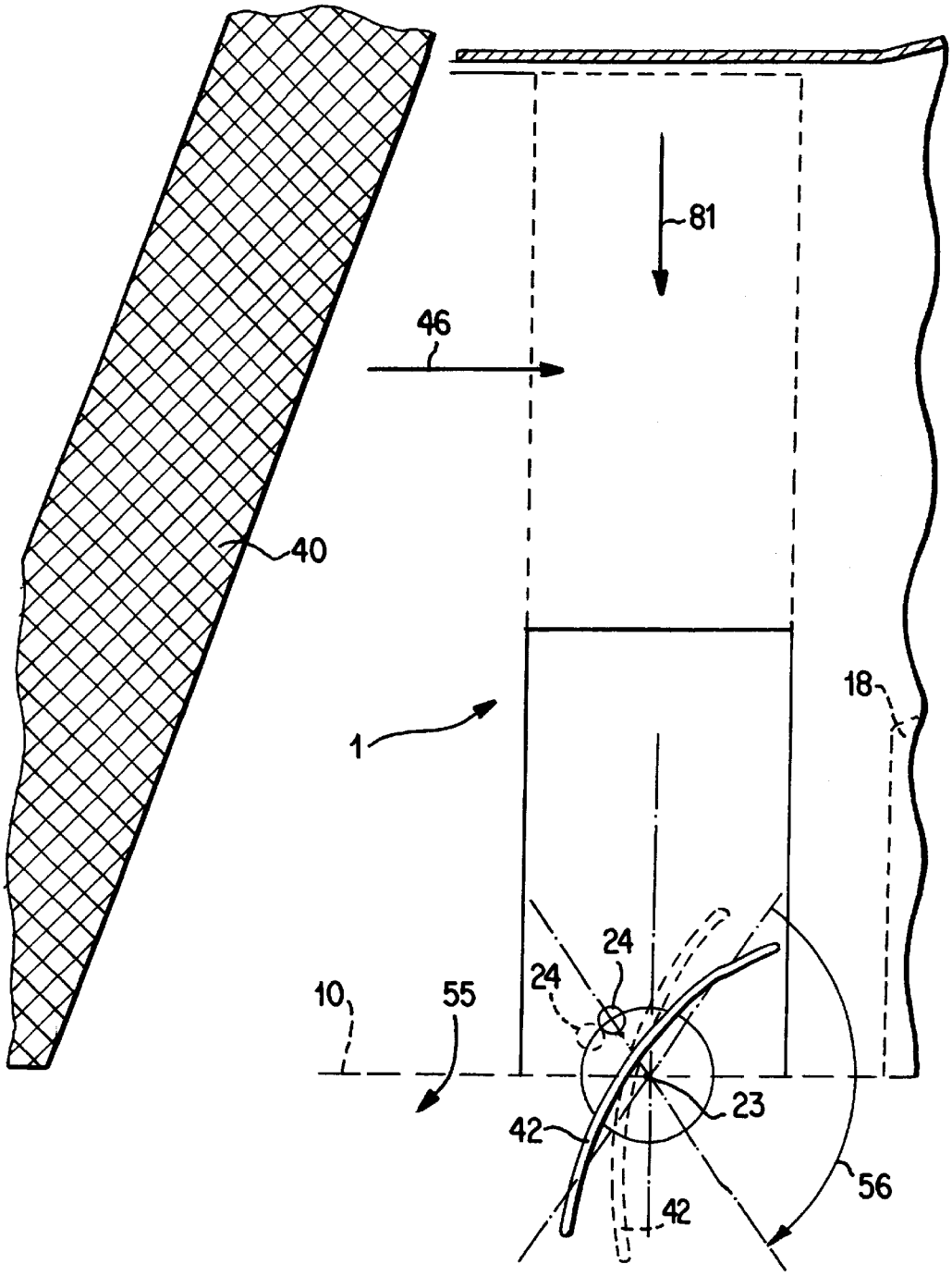
FIG. 8 shows a schematized representation of the fan impeller similar to that in FIG. 3 in association with the radiator or the internal combustion engine, the speed-dependent pushed-out position of the fan blade—reduced cooling performance—being indicated in broken lines.

Starting from a position of the hub 4 in accordance with FIG. 6 and hence based on an arrangement of the fan impeller 1 in accordance with FIG. 9, FIG. 8 shows the position for a fan blade 42 given a direction of delivery 46 in the direction of the internal combustion engine 18, the direction of revolution of the fan impeller 1 being symbolized by arrow 81, in accordance with a direction of rotation 55.

42 denotes that fan blade of the fan impeller 1 which, in the view shown in FIG. 6, relative to its axis of rotary adjustment 23, lies in a plane perpendicular to the plane of the drawing and containing the axis of rotation 10 of the fan impeller 1, with the result that the location hole 43 provided in the peripheral wall of the hub 95 for the mounting 21 of the connecting part 3 lies symmetrically with respect to this plane. In the representation shown in FIG. 8, the fan blade 42 delivers air in the direction of arrow 46, i.e. in the direction of the internal combustion engine 18, and a position of the actuating stub 24 as shown in FIG. 6 corresponds to the position of the fan blade 42 illustrated in solid lines. In FIG. 8, the actuating stub 24 is indicated only schematically. The position of the fan blade 42 illustrated in solid lines in FIG. 8 corresponds to a maximum delivery position as a stop position, which, based on a predetermined speed, is held for the piston 31 as a function of the speed by the springs 77 arranged in the location opening 76 or else as a function of temperature by expandable-material elements 78 or 87 arranged in or engaging in location openings 75 or 86. The supporting force exerted on the piston 11 by means of the springs 77 and/or the expandable-material elements 78 or 87 as stop elements counteracts an air-resistance-dependent actuating force, in addition to the force of the spring 32, with the tendency to force the respective fan blade into a position with a shallow angle of incidence, as indicated in broken lines for the fan blade 42. As with this position of the fan blade 42, the position of the actuating stub 24 is also indicated by broken lines in FIG. 8.

If it is assumed that the internal combustion engine 18 has a working range which is below the maximum speed and in which, based on the maximum torque that can be achieved for this range or the maximum power that can be achieved for this range, a high cooling performance requirement and, in particular, one which corresponds to the maximum cooling performance requirement of the internal combustion engine 18 exists, the position assumed for the fan blade 42 in FIG. 8 and illustrated in solid lines, with a corresponding angle of incidence which is of the order of about 50° based on the embodiment example shown in FIG. 8 corresponds to this. The fan blade 42 is supported in this stop position by the spring 77, the force of the spring 77 counteracting an actuating force which is exerted on the piston 11 as a function of the air resistance by the fan blade 42 and the eccentric connection to the piston 31 in the working range discussed and at the speed prevailing in this range. If the piston 31 is additionally supported by spring 32 in the opposite direction to spring 77, this must be allowed for such that the position of the fan blade 42 in accordance with FIG. 8 corresponds as it were to a position of equilibrium, based on the forces discussed.

If the speed of the internal combustion engine increases beyond the range mentioned, the actuating force exerted on the fan blade 42 as a function of the air resistance increases, with the result that the spring 77 acting as stop element is compressed and the fan blade 42 pivots into a shallower position, as indicated in broken lines for the fan blade 42 in FIG. 8, the angle of incidence in this position of the fan blade 42 being shallower, and this angle of incidence being assigned the position of the actuating stub 24 indicated in broken lines. This position of the actuating stub 24 in broken lines corresponds to a non-illustrated position of the piston 31 shown in FIG. 6, in which the piston 31 rests by its rim 79 against the bottom 101 as a fixed stop.

The working range discussed above corresponds to a particular cooling performance requirement and hence also to a certain temperature level to which the hub 4 is exposed. Using an expandable-material element operating in a temperature-dependent manner as a stop element, this being indicated by 78 and 87 in FIG. 6, it is possible, based on the temperature discussed, to achieve a position of the piston 31 (by corresponding deflection of the expandable-material element 78 or 87) which corresponds, in line with the above description, to a position of the fan blade 42 as illustrated in solid lines in FIG. 8, and this position corresponding, for its part, to a maximum cooling performance requirement. If, on the other hand, there is a fall in temperature, owing, for example, to a rise in the air delivery rate due to the speed while the angle of incidence of the fan blades 42 remains the same, without an increase in the cooling performance requirement of the internal combustion engine 18, the temperature falls and the deflection of the expandable-material element 78 or 87 decreases such that, as with the compression of the spring 77 with increasing speed, the piston 31 is displaced in the direction of the bottom 101 and the fan blade 42 pivots back into a position with a shallower angle of incidence.

If resilient stop elements (spring 77) and stop elements that operate in a temperature-dependent manner (expandable-material element 78 or 87) are used in combination as stop elements, the corresponding functions complement one another and the stop element, which operates in a temperature-dependent manner and is, in particular, designed as an expandable-material element 78 or 87 but can also be designed as a bimetallic spring, ensures that, given a corresponding cooling performance requirement, the angle of incidence input for the fan blade 42 allows for the increased cooling performance requirement by means of the temperature-dependently operating stop element, irrespective of the speed, and the actuating travels that arise and are required for the respective supporting elements are relatively small. If a bimetallic spring is used, it can perform the functions both of a spring and an expandable-material element, being a speed- and temperature-dependently operating stop element, i.e. a combined stop element.

FIG. 9 shows a preferred application for a fan impeller 1 according to the invention in conjunction with a tractor, the tractor being denoted overall by 82 and having a frame part 83 which is supported at the front by wheels 84 in the region of the front axle. Situated in the region of the front axle between the wheels 84 is the internal combustion engine 18, which is mounted in front of the radiator, the fan impeller 1 being situated between the radiator 40 and the internal combustion engine 18, that is to say, for example, a fan impeller 1 equipped in accordance with the invention, which is driven in the customary manner by means of the crank shaft of the internal combustion engine 18.

Provided at the front end of the frame 83 is a connecting frame 85 on which implements or the like can be mounted by means of a three-point lifting device, for example.

If such implements are arranged at the front of the tractor 82, in particular, they can lead to considerable pollution with dust and/or plant particles of the air used on the tractor as cooling air and delivered toward the internal combustion engine 18 (arrow 46) by the fan impeller 1 via the radiator 40 when these implements are being used, depending on the area of application, for example as soil tilling implements, harvesting machines or hay-making machines. The opposite direction is symbolized by the arrow 47. This pollution of the air can lead to considerable cooling problems, quite apart from the fact that the fan impeller always delivers the full quantity of cooling air possible at the particular speed due to the direct drive connection of the fan impeller 1 to the crankshaft of the internal combustion engine 18. These problems are exacerbated when tractor silhouettes are made as slim as possible, as is desirable in order to obtain as good a view as possible of the implements since, given these considerations, radiator surface areas and areas of inflow to the radiator 40 are kept as small as possible and air velocities are therefore high when the cooling air is delivered in the direction 46 of the internal combustion engine 4, even in the area of inflow to the radiator 40. The problems which arise in conjunction with such configurations due to the progressive blockage of the radiator 40 are eliminated in the case of the solution according to the invention by the fact that the flow of cooling air is briefly reversed and, as explained in greater detail by means of the above description, the radiator 40 is cleared by flow through it in the opposite direction.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A fan impeller assembly for cooling systems of internal combustion engines, comprising:

a cup shaped hub, and adjustable fan blades which are guided rotatably in a peripheral wall of the hub, and an actuating drive operable to adjust the fan blades and situated in the cup-shaped hub, said actuating drive including:

an actuating element spring-loaded toward an initial position and acted upon in an opposite direction by a pressure medium, adjusting eccentrics which are situated at a transition between said actuating element and the fan blades and can be acted upon by the actuating element, the actuating element being formed by a concentrically arranged actuating piston which adjoins the cup wall in a sealing manner and is guided by the latter, wherein a piston wall of the actuating piston lies in radial overlap with the fan blades as an actuating ring for receiving actuating stubs of the adjusting eccentrics, and wherein, by a pressure medium acting on the actuating piston, the fan blades can be changed over into a direction of delivery opposite to a direction of delivery in an initial position and, in both of the opposite directions of delivery, are loaded in the directions of the blade position corresponding to the respective direction of delivery.

2. The fan impeller assembly as claimed in claim 1, wherein the fan blades are loaded in the direction of the blade position corresponding to the respective direction of delivery by the force associated with air resistance.

3. The fan impeller assembly as claimed in claim 2, wherein the fan blades are acted upon in their respective position by the force associated with air resistance as a self-holding force which is independent of the actuating device, acts in the direction of their respective end position and is smaller than the restoring force which acts on the actuating piston due to the spring force in the opposite direction to the loading imposed by the pressure medium.

4. The fan impeller assembly as claimed in claim 1, wherein, in both end positions, which correspond to the opposite directions of delivery, the actuating stubs lie on the same side of a radial plane containing the axis of rotation of the fan impeller, based on the axial direction of delivery of the fan impeller.

5. The fan impeller assembly as claimed in claim 1, wherein—viewed radially—the fan blades each arch outwards in a direction opposite to the direction of delivery in both their end positions corresponding to the opposite directions of delivery.

6. The fan impeller assembly as claimed in claim 1, wherein, between their end positions, the fan blades are rotated relative to one another by more than 90° in particular by about 110°, based on their axis of rotation.

7. The fan impeller assembly as claimed in claim 1, wherein, viewed radially and based on the direction of rotation of the fan impeller, the fan blades each arch outwards counter to the direction of rotation.

8. The fan impeller assembly as claimed in claim 1, wherein—viewed radially and based on the direction of rotation of the fan impeller—the rear end of the fan blades extends rearwards obliquely to the respective direction of delivery and counter to the direction of rotation of the fan impeller, and their forward end extends essentially in the circumferential direction of the fan impeller.

9. The fan impeller assembly as claimed in claim 1, wherein that initial position of the actuating piston that can be adopted by virtue of the elastic support counter to the direction of adjustment by loading with pressure medium corresponds to a normal working position, and that end position of the actuating piston which can be adopted by loading with pressure medium corresponds to a brief working position.

10. The fan impeller assembly as claimed in claim 9, wherein the position of the fan blades can be switched over from the brief working position to the normal working position by reduction, in particular time-controlled reduction, of the pressure prevailing after the pressure source is switched off.

11. The fan impeller assembly as claimed claim 1, wherein the spring-loaded initial position of the actuating piston is stop-limited counter to the spring force and the position of the limiting stop can be varied as a function of speed and/or temperature.

12. The fan impeller assembly as claimed in claim 11, wherein the initial position corresponds to a position of the fan blades of the fan impeller in which the delivery rate is high, in particular in the region of the maximum, and wherein the initial position is assigned to a working range of the internal combustion engine in which the speed of the internal combustion engine is below its maximum speed, and the cooling performance requirement is high, in particular in the region of the maximum.

13. The fan impeller assembly as claimed in claim 11, wherein the limiting stop is formed by stop elements which load the actuating piston in an elastically flexible manner in the direction of the initial position.

14. The fan impeller assembly as claimed in claim 12, wherein the limiting stop is formed by stop elements which load the actuating piston in an elastically flexible manner in the direction of the initial position.

15. The fan impeller assembly as claimed in claim 13, wherein the support serving as a limiting stop is formed by at least one spring and/or by at least one element composed of elastic material, in particular rubber-elastic material, and/or by at least one supporting element whose length varies as a function of temperature, in particular an expandable-material element.

16. The fan impeller assembly as claimed in claim 13, wherein the stop elements serving as the limiting stop can be adjusted out of their position corresponding to the initial position of the fan blades by means of the air-resistance-dependent actuating force acting on the fan blades, such that the fan blades can be adjusted into a position associated with a reduced delivery rate as a function of the air-resistance-dependent actuating force.

17. The fan impeller assembly as claimed in claim 15, wherein the stop elements serving as the limiting stop can be adjusted out of their position corresponding to the initial position of the fan blades by means of the air-resistance-dependent actuating force acting on the fan blades, such that the fan blades can be adjusted into a position associated with a reduced delivery rate as a function of the air-resistance-dependent actuating force.

18. A fan impeller assembly for cooling systems of internal combustion engines, comprising:

a cup shaped hub, adjustable fan blades which are guided rotatably in a peripheral wall of the hub, and an actuating drive operable to adjust the fan blades and situated in the cup-shaped hub, said actuating drive including:

an actuating element spring-loaded toward an initial position and acted upon in an opposite direction by a pressure medium, and adjusting eccentrics which are situated at a transition between said actuating element and the fan blades and can be acted upon by the actuating element, the actuating element being formed by a concentrically arranged actuating piston which adjoins the cup wall in a sealing manner and is guided by the latter, wherein the spring-loaded initial position of the actuating piston is stop-limited counter to the spring force and the position of the limiting stop can be varied as a function of speed and/or temperature.

19. The fan impeller assembly according to claim 18, wherein the initial position corresponds to a position of the fan blades of the fan impeller in which the delivery rate is high, in particular in the region of the maximum, and wherein the initial position is assigned to a working range of the internal combustion engine in which the speed of the internal combustion engine is below its maximum speed, and the cooling performance requirement is high, in particular in the region of the maximum.

20. The fan impeller assembly according to claim 19, wherein the limiting stop is formed by stop elements which load the actuating piston in an elastically flexible manner in the direction of the initial position.

21. The fan impeller assembly according to claim 20, wherein the support serving as a limiting stop is formed by at least one spring and/or by at least one element composed of elastic material, in particular rubber-elastic material, and/or by at least one supporting element whose length varies as a function of temperature, in particular an expandable-material element.

22. The fan impeller assembly according to claim 21, wherein the stop elements serving as the limiting stop can be adjusted out of their position corresponding to the initial position of the fan blades by means of the air-resistance-dependent actuating force acting on the fan blades, such that the fan blades can be adjusted into a position associated with a reduced delivery rate as a function of the air-resistance-dependent actuating force.

* * * * *